US012753571B2

(12) United States Patent
Hatake et al.

(10) Patent No.: US 12,753,571 B2
(45) Date of Patent: Oct. 6, 2026

(54) CONTROL DEVICE, WORK MACHINE, CONTROL METHOD, AND CONTROL SYSTEM

(71) Applicant: Komatsu Ltd., Tokyo (JP)

(72) Inventors: Kazuhiro Hatake, Tokyo (JP); Yusuke Saigo, Tokyo (JP)

(73) Assignee: Komatsu Ltd., Tokyo (JP)

( * ) Notice: Subject to any disclaimer, the term of this patent is extended or adjusted under 35 U.S.C. 154(b) by 47 days.

(21) Appl. No.: 18/683,003

(22) PCT Filed: Sep. 5, 2022

(86) PCT No.: PCT/JP2022/033248
§ 371 (c)(1),
(2) Date: Feb. 12, 2024

(87) PCT Pub. No.: WO2023/038000
PCT Pub. Date: Mar. 16, 2023

(65) Prior Publication Data

US 2024/0352705 A1 Oct. 24, 2024

(30) Foreign Application Priority Data

Sep. 10, 2021 (JP) ..... 2021-148004

(51) Int. Cl.
*E02F 3/43* (2006.01)
*E02F 3/30* (2006.01)
*E02F 9/22* (2006.01)

(52) U.S. Cl.
CPC ..... *E02F 3/439* (2013.01); *E02F 3/308* (2013.01); *E02F 3/437* (2013.01); *E02F 9/2203* (2013.01)

(58) Field of Classification Search
CPC . E02F 3/439; E02F 3/308; E02F 3/437; E02F 9/2203; E02F 9/262; E02F 3/43;
(Continued)

(56) References Cited

U.S. PATENT DOCUMENTS

2013/0103247 A1* 4/2013 Ogawa ..... E02F 9/265 701/23
2018/0016768 A1 1/2018 Izumikawa
(Continued)

FOREIGN PATENT DOCUMENTS

CN 1826448 A 8/2006
JP 2002-030690 A 1/2002
(Continued)

OTHER PUBLICATIONS

Machine Translation of WO-2016158779-A1 obtained from Clarivate Analytics on Aug. 22, 2025 (Year: 2016).*

*Primary Examiner* — Fadey S. Jabr
*Assistant Examiner* — Michael J Herrera
(74) *Attorney, Agent, or Firm* — Fish & Richardson P.C.

(57) ABSTRACT

A control device of a work machine includes work equipment including a work tool and is configured to perform an automatic loading control of holding a posture of the work tool in a target posture and moving a position of the work tool up to a target position, in which in the automatic loading control, when the posture of the work tool is out of a predetermined range from the target posture, the control device is configured to prioritize a control of the posture of the work tool over a control of the position of the work tool until the posture of the work tool falls within the predetermined range.

8 Claims, 10 Drawing Sheets

(58) Field of Classification Search
CPC . E02F 9/2221; E02F 9/2246; B60Y 2200/412
See application file for complete search history.

(56) References Cited

U.S. PATENT DOCUMENTS

| | | | | |
|---|---|---|---|---|
| 2018/0119384 | A1 | 5/2018 | Imaizumi et al. | |
| 2021/0002851 | A1* | 1/2021 | Morita | E02F 9/2242 |
| 2021/0102357 | A1 | 4/2021 | Okuwaki et al. | |
| 2021/0164192 | A1 | 6/2021 | Konda et al. | |
| 2021/0246625 | A1 | 8/2021 | Oi et al. | |
| 2022/0010523 | A1 | 1/2022 | Izumikawa | |
| 2022/0186459 | A1* | 6/2022 | Igarashi | E02F 9/265 |
| 2022/0333344 | A1* | 10/2022 | Kean | E02F 3/434 |
| 2022/0341124 | A1 | 10/2022 | Sugiyama | |
| 2022/0403623 | A1* | 12/2022 | Wu | E02F 9/2203 |

FOREIGN PATENT DOCUMENTS

| | | | | |
|---|---|---|---|---|
| JP | 2019-173558 | A | 10/2019 | |
| JP | 2019-190236 | A | 10/2019 | |
| JP | 2020-041352 | A | 3/2020 | |
| JP | 2000/096601 | A | 4/2022 | |
| WO | WO-2016158779 | A1 * | 10/2016 | E02F 3/439 |
| WO | 2020/044842 | A1 | 3/2020 | |
| WO | 2020/196888 | A1 | 10/2020 | |
| WO | 2021/145346 | A1 | 7/2021 | |

* cited by examiner

FIG. 8

| | | RELATIONSHIP BETWEEN BUCKET HEIGHT AND STICK CONTROL START HEIGHT THRESHOLD | |
|---|---|---|---|
| | | BUCKET HEIGHT IS HIGHER THAN STICK CONTROL START HEIGHT THRESHOLD | BUCKET HEIGHT IS LOWER THAN STICK CONTROL START HEIGHT THRESHOLD |
| RELATIONSHIP BETWEEN BUCKET ANGLE AND RANGE OF ALLOWABLE ANGLE | BUCKET ANGLE IS IN RANGE OF ALLOWABLE ANGLE | (C3) | (C2) |
| | BUCKET ANGLE IS OUT OF RANGE OF ALLOWABLE ANGLE | (C1) | (C1) |

FIG. 9

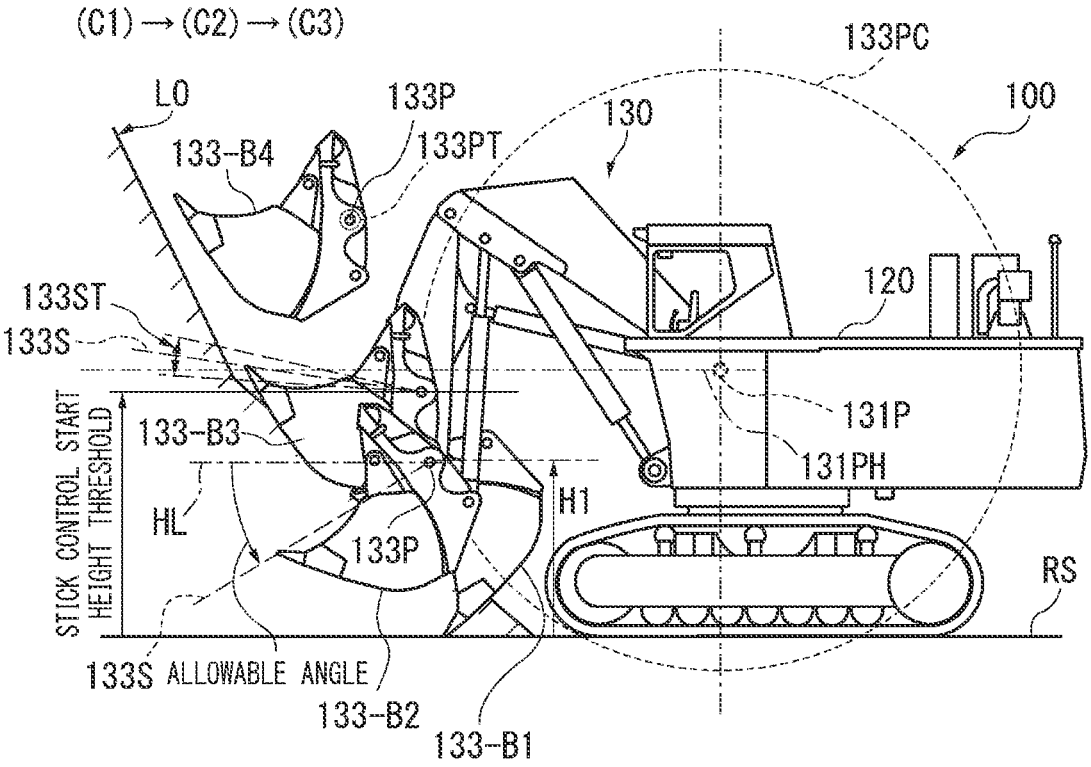

CONTROL DEVICE, WORK MACHINE, CONTROL METHOD, AND CONTROL SYSTEM

CROSS-REFERENCE TO RELATED APPLICATIONS

This application is a National Stage application under 35 U.S.C. § 371 of International Application No. PCT/JP2022/033248, filed on Sep. 5, 2022, which claims priority to Japanese Patent Application No. 2021-148004, filed Sep. 10, 2021. The contents of the prior applications are incorporated herein in their entirety.

TECHNICAL FIELD

The present disclosure relates to a control device, a work machine, a control method, and a control system.

BACKGROUND ART

A control device disclosed in Patent Document 1 is a control device of a loading machine, where the loading machine includes a swing body and work equipment attached to the swing body and having a bucket, and performs automatic excavation/loading control in accordance with the following. That is, in the automatic excavation/loading control by the control device disclosed in Patent Document 1, a series of operations for swinging the swing body to move the work equipment to an excavation point, excavating earth at the excavation point, and swinging the swing body and loading the earth stored in the bucket into a loading target are automatically performed. Here, the loading target is a transport vehicle, a hopper, or the like.

Additionally, a control device is disclosed in Patent Document 2 which performs the following automatic loading control. The automatic loading control disclosed in Patent Document 2 is started when an operator turns on a switch of an operation device. In this case, the operator turns on the switch when the operator determines that a loading machine and a loading target, such as a transport vehicle or a hopper, are positioned such that loading processing can be performed. When the switch is turned on, the operation device generates a loading instruction signal and outputs the loading instruction signal to the control device. When the loading instruction signal is input to the control device, the control device specifies the position of the work equipment as an excavation completion position and specifies a loading position based on the position and shape of the loading target. The control device controls the work equipment such that the work equipment reaches the loading position from the excavation completion position. Further, in such case, the control device controls the work equipment such that the angle between the bucket and the ground is not changed.

CITATION LIST

Patent Documents

Patent Document 1
Japanese Unexamined Patent Application, First Publication No. 2020-41352
Patent Document 2
Japanese Unexamined Patent Application, First Publication No. 2019-190236

SUMMARY OF INVENTION

Technical Problem

As described above, in the automatic loading control disclosed in Patent Document 2, a position where a loading instruction signal is generated is specified as an excavation completion position and work equipment is controlled to reach a loading position. For this reason, an operation for pushing a bucket into an excavation surface and an operation for lifting the bucket may occur simultaneously, for example, when an operator turns on a switch of an operation device in a state where the bucket is still present on the excavation surface, and there is a possibility that a load applied to the work equipment is likely to be increased.

The present disclosure has been made in consideration of the above-mentioned circumstances, and an object of the present disclosure is to provide a control device, a work machine, a control method, and a control system that can appropriately control a load applied to work equipment.

Solution to Problem

A control device according to an aspect of the present disclosure is a control device of a work machine that includes work equipment including a work tool, the control device being configured to perform an automatic loading control of holding a posture of the work tool in a target posture and moving a position of the work tool up to a target position, in which in the automatic loading control, when the posture of the work tool is out of a predetermined range from the target posture, the control device is configured to prioritize a control of the posture of the work tool over a control of the position of the work tool until the posture of the work tool falls within the predetermined range.

Advantageous Effects of Invention

According to the control device, the work machine, the control method, and the control system of aspects of the present disclosure, it is possible to appropriately control a load applied to a work equipment.

BRIEF DESCRIPTION OF DRAWINGS

FIG. 8 is a table showing an operation example of the controller according to the embodiment of the present disclosure.

FIG. 9 is a side view showing an operation example of the work machine according to the embodiment of the present disclosure.

DESCRIPTION OF EMBODIMENTS

Figure 1:
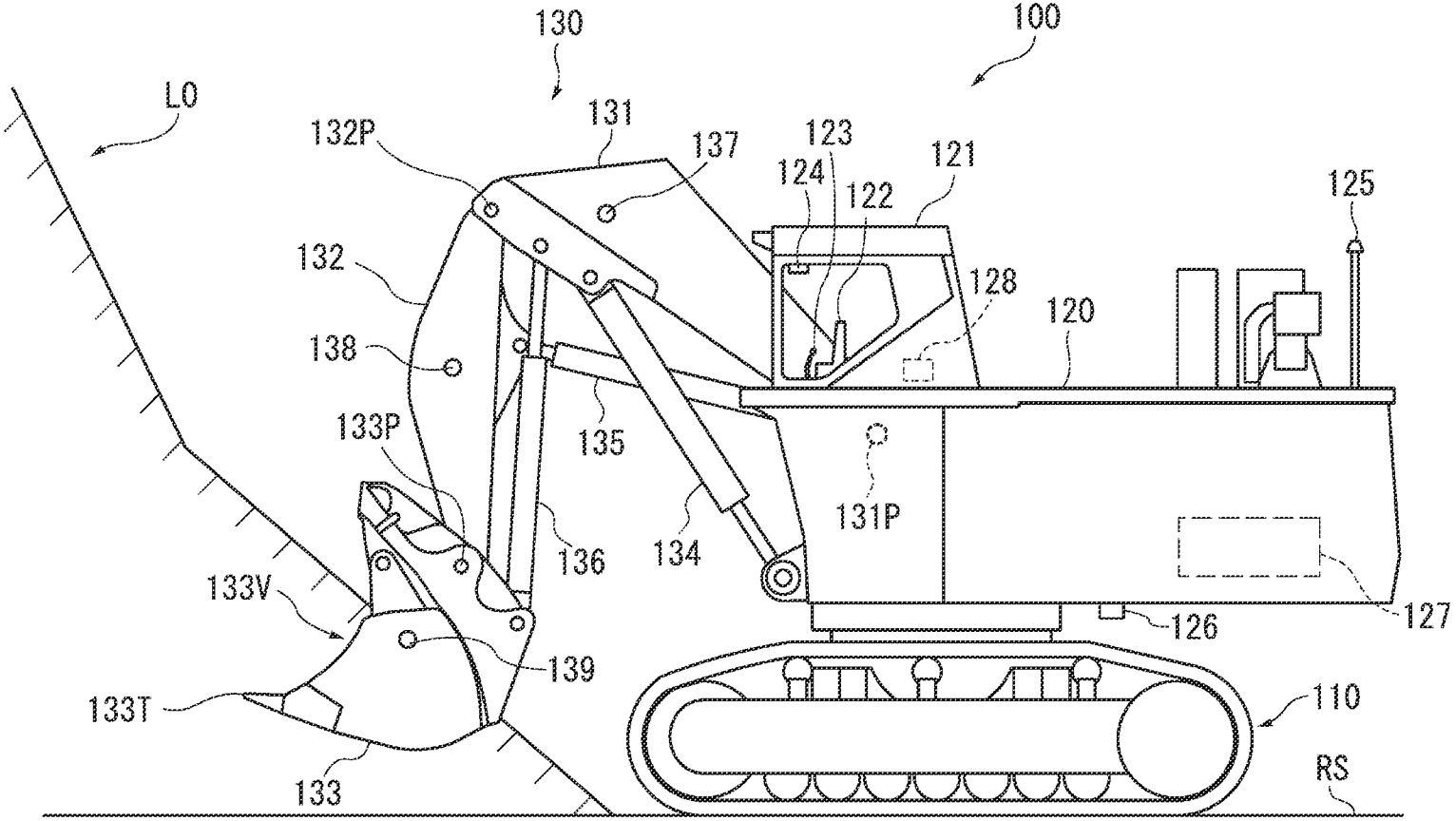
FIG. 1 is a schematic diagram showing a configuration of a work machine according to an embodiment of the present disclosure.
Figure 2:
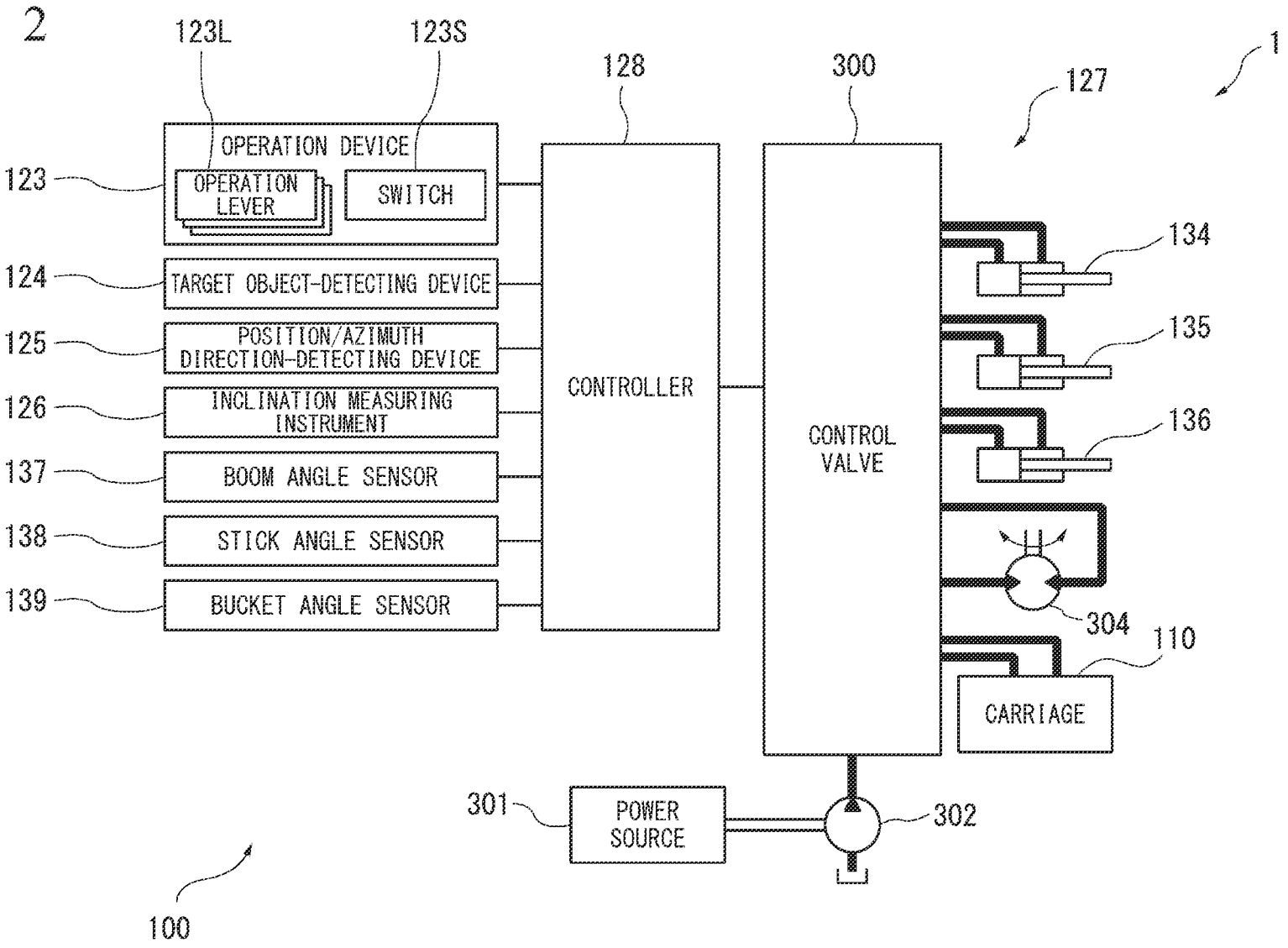
FIG. 2 is a block diagram showing an example configuration of a control system of the work machine according to the embodiment of the present disclosure.
Figure 3:
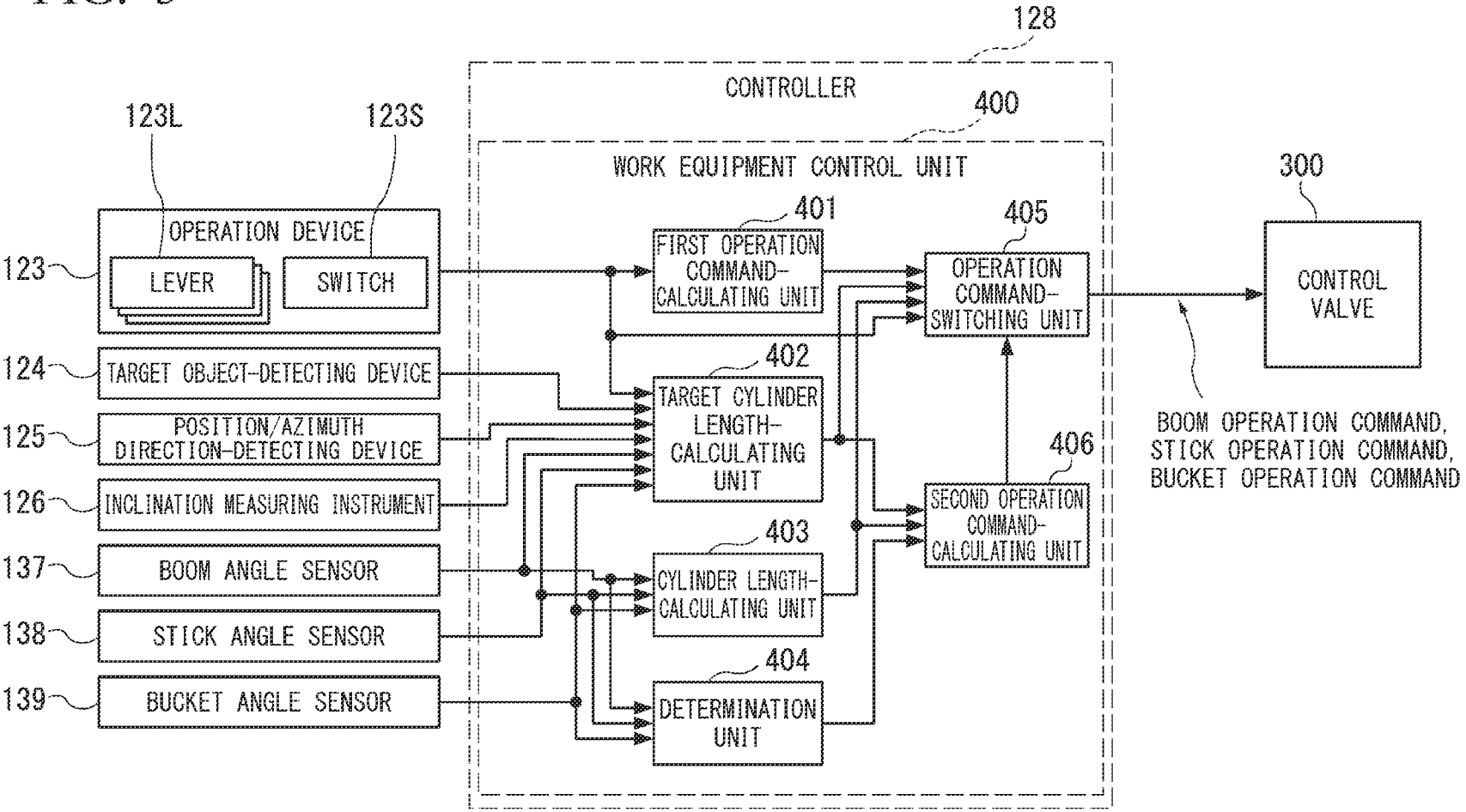
FIG. 3 is a schematic block diagram showing a configuration of a controller according to the embodiment of the present disclosure.
Figure 4:
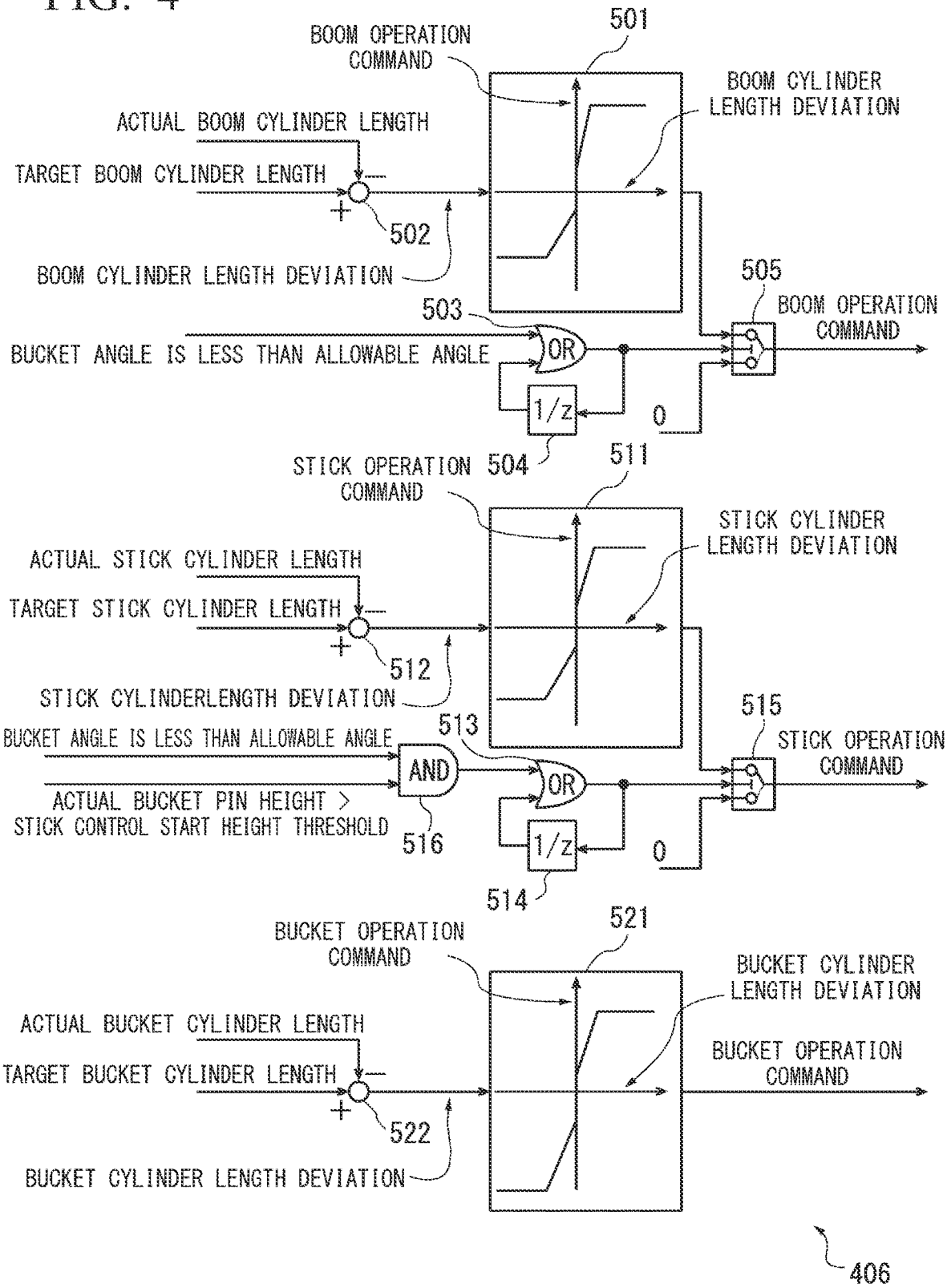
FIG. 4 is a schematic block diagram showing a configuration of part of the controller according to the embodiment of the present disclosure.
Figure 5:
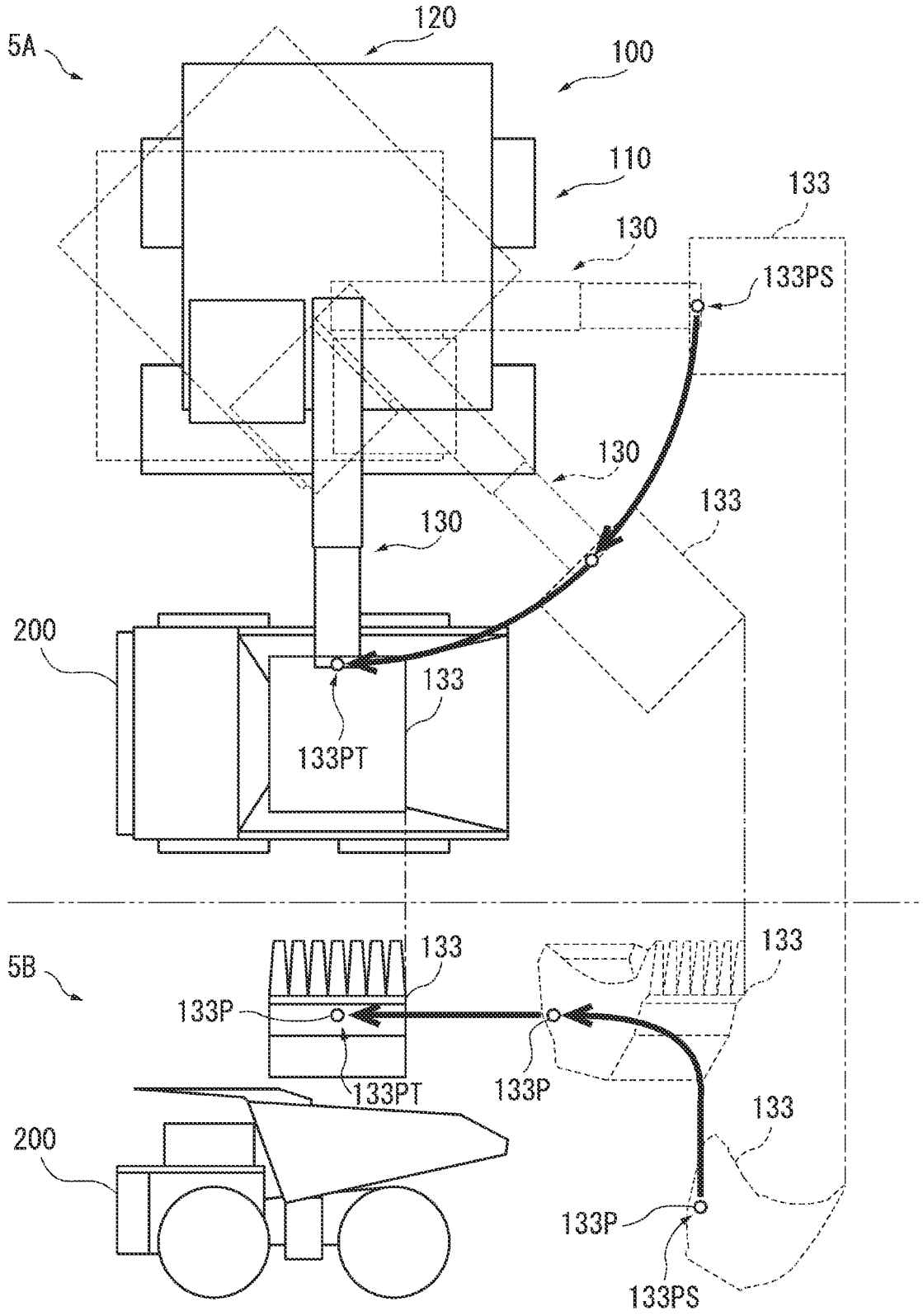
FIG. 5 is a diagram showing an example of a path of a bucket according to the embodiment of the present disclosure.
Figure 6:
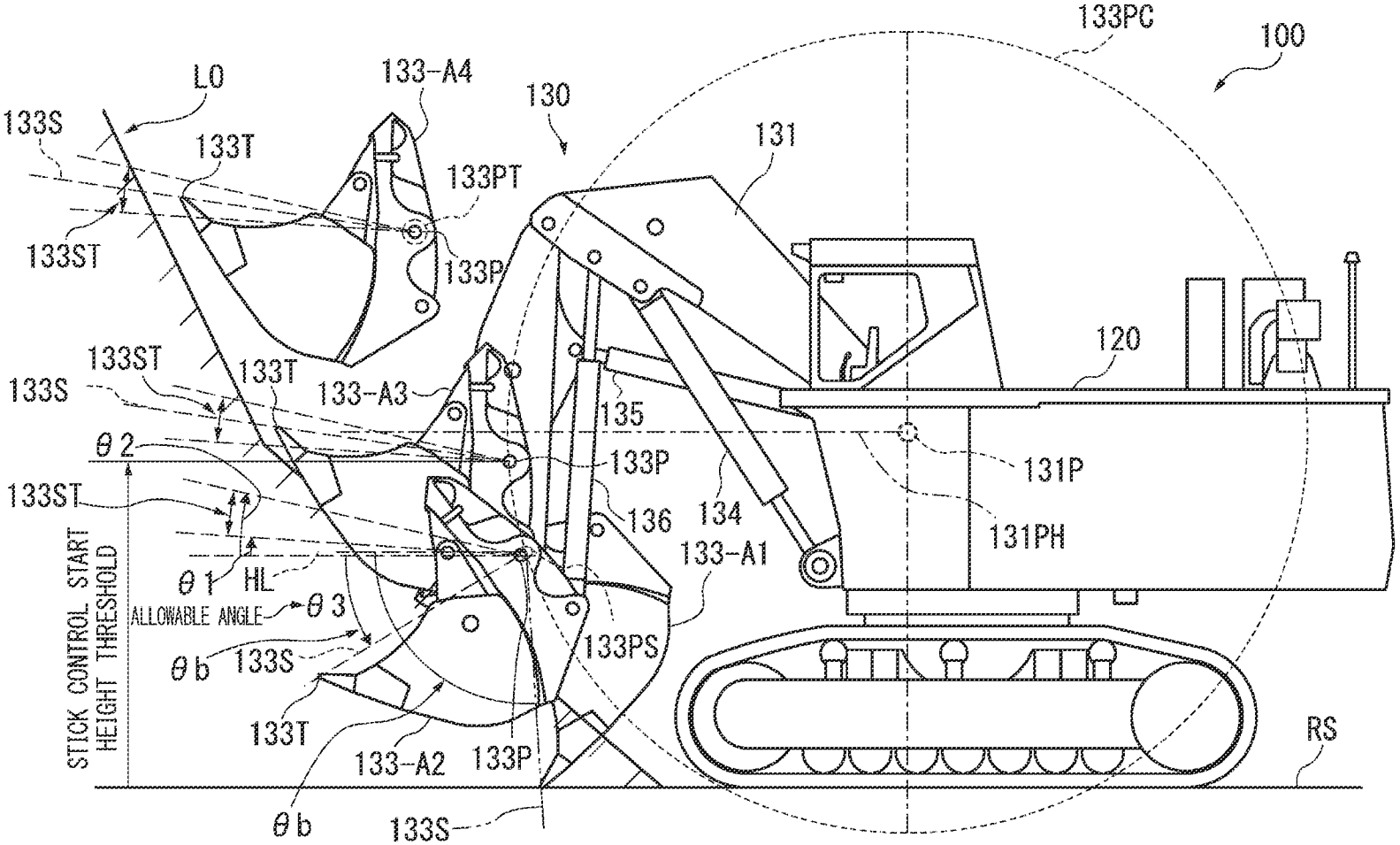
FIG. 6 is a side view showing an operation example of the work machine according to the embodiment of the present disclosure.
Figure 7:
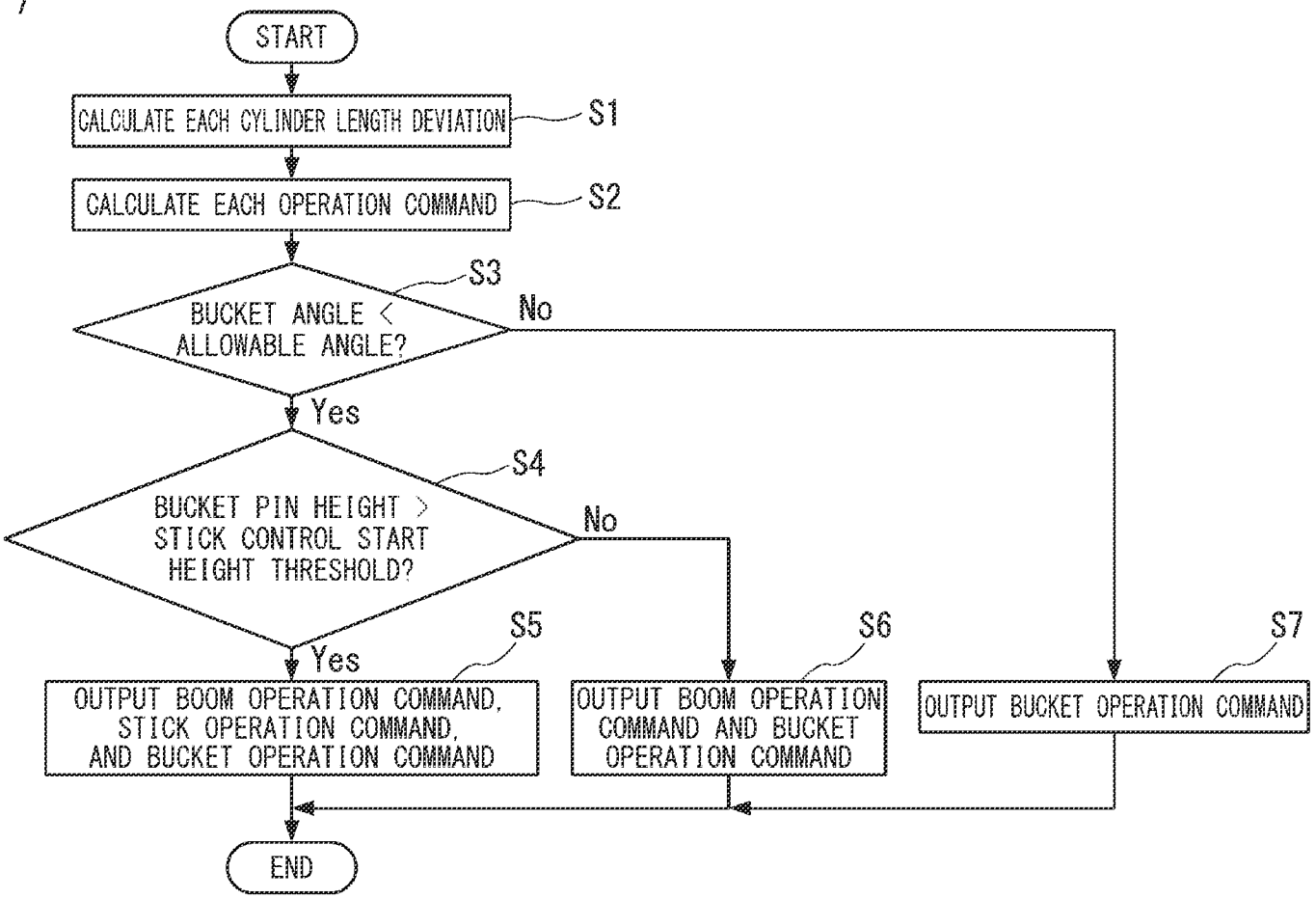
FIG. 7 is a flowchart showing an operation example of the controller according to the embodiment of the present disclosure.

Embodiments of the present disclosure will be described below with reference to the drawings. The same or corresponding components will be denoted in the respective drawings by the same reference numeral and a repeat description thereof will be omitted as appropriate. FIG. 1 is a schematic diagram showing a configuration of a work machine according to an embodiment of the present disclosure. FIG. 2 is a block diagram showing an example configuration of a control system of the work machine according to the embodiment of the present disclosure. FIG. 3 is a schematic block diagram showing a configuration of a controller according to the embodiment of the present disclosure. FIG. 4 is a schematic block diagram showing a configuration of part of the controller according to the embodiment of the present disclosure. FIG. 5 is a diagram showing an example of a path of a bucket according to the embodiment of the present disclosure. FIG. 6 is a side view showing an operation example of the work machine according to the embodiment of the present disclosure. FIG. 7 is a flowchart showing an operation example of the controller according to the embodiment of the present disclosure. FIG. 8 is a table showing an operation example of the controller according to the embodiment of the present disclosure. FIGS. 9 to 12 are side views showing operation examples of the work machine according to the embodiment of the present disclosure.

Configuration of Work Machine

As shown in FIGS. 1 and 5, a work machine 100 is used for loading a loading target object LO, such as earth, into a loading target 200, such as a transport vehicle. The work machine 100 according to the embodiment of the present disclosure is a hydraulic excavator. A work machine 100 according to another embodiment may be a work machine 100 other than a hydraulic excavator. Further, the work machine 100 shown in FIG. 1 is a face excavator but may be a backhoe excavator or a rope excavator. Examples of the loading target 200 include a transport vehicle, a hopper, and the like.

As shown in FIG. 1, the work machine 100 includes a carriage 110, a swing body 120 that is supported by the carriage 110, and work equipment 130 that is operated by hydraulic pressure and is supported by the swing body 120.

The carriage 110 includes crawler tracks and travels on a road surface RS or the ground. The carriage 110 may include wheels, not the crawler tracks. The swing body 120 is supported by the carriage 110 to be swingable about a swing center.

The work equipment 130 includes a boom 131, a stick 132, a bucket 133, a boom cylinder 134, a stick cylinder 135, a bucket cylinder 136, a boom angle sensor 137, a stick angle sensor 138, and a bucket angle sensor 139. The work equipment 130 changes the position and posture of the bucket 133 according to the control of a controller 128.

A proximal end portion of the boom 131 is attached to the swing body 120 via a boom pin 131P. The stick 132 connects the boom 131 and the bucket 133. A proximal end portion of the stick 132 is attached to a distal end portion of the boom 131 via a stick pin 132P. The bucket 133 includes a blade 133T that is used to excavate earth and the like, and a container 133V that is used to store the excavated earth. A proximal end portion of the bucket 133 is attached to a distal end portion of the stick 132 via a bucket pin 133P. The bucket 133 is an example of a work tool that is used to excavate, load, and dump the loading target object LO. Further, the swing body 120 is an example of a main body of the work machine 100. The boom 131 is an example of a first member of which one end portion is attached to the swing body 120 via a pin and the other end portion is attached to the stick 132 via a pin. The stick 132 is an example of a second member of which one end portion is attached to the boom 131 via a pin and the other end is attached to the bucket 133 via a pin. In this case, the work machine 100 includes the work equipment 130 and the swing body 120 that supports the work equipment 130, and the work equipment 130 includes the boom 131, the stick 132, and the bucket 133.

The boom cylinder 134 is a hydraulic cylinder that is used to operate the boom 131. A proximal end portion of the boom cylinder 134 is attached to the swing body 120. A distal end portion of the boom cylinder 134 is attached to the boom 131. The stick cylinder 135 is a hydraulic cylinder that is used to drive the stick 132. A proximal end portion of the stick cylinder 135 is attached to the boom 131. A distal end portion of the stick cylinder 135 is attached to the stick 132. The bucket cylinder 136 is a hydraulic cylinder that is used to drive the bucket 133. A proximal end portion of the bucket cylinder 136 is attached to the boom 131. A distal end portion of the bucket cylinder 136 is attached to the bucket 133.

The boom angle sensor 137 is attached to the boom 131 and detects an angle of the inclination of the boom 131. The stick angle sensor 138 is attached to the stick 132 and detects an angle of the inclination of the stick 132. The bucket angle sensor 139 is attached to the bucket 133 and detects an angle of the inclination of the bucket 133. The boom angle sensor 137, the stick angle sensor 138, and the bucket angle sensor 139 according to the embodiment of the present disclosure detect angles of the inclination with respect to a horizon plane. Each of the boom angle sensor 137, the stick angle sensor 138, and the bucket angle sensor 139 may be formed using, for example, an inertial measurement unit. The inertial measurement unit is also called IMU or the like.

Angle sensors according to another embodiment are not limited thereto and may detect angles of the inclination with respect to another reference plane. For example, in another embodiment, the angle sensors may detect relative rotation angles using potentiometers provided at the proximal end portions of the boom 131, the stick 132, and the bucket 133, or may measure the cylinder lengths of the boom cylinder 134, the stick cylinder 135, and the bucket cylinder 136 and convert the cylinder lengths into angles to detect angles of the inclination.

The swing body 120 is provided with a cab 121. A cab seat 122 in which an operator is to sit, an operation device 123 that is used to operate the work machine 100, and a target object-detecting device 124 that is used to detect a three-dimensional position of a target object present in a detection direction are provided in the cab 121. As shown in FIG. 2, the operation device 123 includes a plurality of operation levers 123L, a switch 123S, a pedal, and the like. In response to operations of the operator on the operation levers 123L, the operation device 123 generates an operation signal of the boom cylinder 134, an operation signal of the stick cylinder 135, an operation signal of the bucket cylinder 136, a swing operation signal of the swing body 120 in the left and right, and a traveling operation signal for forward and backward movement of the carriage 110, and outputs the operation signals to the controller 128. The controller 128 is an example configuration of a control device of the present disclosure. Further, the operation device 123 generates a loading instruction signal for causing the work equipment 130 to start automatic loading control in response to the operation of the operator and outputs the loading instruction signal to the controller 128. The loading instruction signal is an example of an instruction to start automatic movement of the bucket 133. The loading instruction signal is generated by the operation of the switch 123S. For example, when the switch 123S is pressed, a loading instruction signal, which is a signal instructing to start automatic loading control to be described later, is output. The operation device 123 is disposed near the cab seat 122. The operation device 123 is positioned such that the operator can operate the operation device 123 when the operator is sitting in the cab seat 122. In the present embodiment, the automatic loading control starts when the switch 123S is turned on, regardless of whether the levers are operated or not. At that time, when the operator determines that, for example, the work machine 100 and the loading target 200, such as a transport vehicle or a hopper, are positioned such that loading processing can be performed, the operator turns on the switch 123S. When the switch 123S is turned on, the operation device 123 generates a loading instruction signal and outputs the loading instruction signal to the controller 128. When the loading instruction signal is input to the controller 128, the controller 128 specifies the position of the work equipment 130 as an excavation completion position and specifies a loading position based on the position and shape of the loading target 200. The controller 128 controls the work equipment 130 such that the work equipment 130 reaches the loading position from the excavation completion position. Further, at that time, the controller 128 controls the work equipment 130 such that the angle of the bucket 133 to the ground is not changed. It is preferable that the automatic loading control is started by the switch 123S in a state where the operator does not operate the lever.

Examples of the target object-detecting device 124 include a stereo camera, a laser scanner, an ultra-wide band (UWB) distance-measuring device, and the like. The target object-detecting device 124 is provided such that a detection direction of the target object-detecting device 124 faces the front of the cab 121 of the work machine 100.

The work machine 100 according to the embodiment of the present disclosure is operated according to the action of the operator who sits in the cab seat 122, but another embodiment is not limited thereto. For example, a work machine 100 according to another embodiment may be operated by a remote operation. For example, a remote operation room that includes an operation device equivalent to the operation device 123 and a monitoring device for monitoring information obtained from the work machine 100 is provided at a position separated from the work machine 100. Further, the work machine 100 is provided with a camera that images the surroundings, a measurement device that measures the position or distance of a surrounding person, a surrounding object, or the like, and the like; the operator monitors information that is obtained from the camera, the measurement device, and the like in the remote operation room; and the work machine 100 controls the carriage 110, the swing body 120, the work equipment 130, and the like based on information about the operation of the operator on the operation device. Further, a control device that has functions equivalent to the functions of the controller 128 or part thereof may be provided in the remote operation room, and all the functions of the controller 128 or part thereof may be performed by the control device during a remote operation.

The work machine 100 includes a position/azimuth direction-detecting device 125, an inclination measuring instrument 126, a hydraulic device 127, and a controller 128.

The position/azimuth direction-detecting device 125 computes the position of the swing body 120 and an azimuth direction which the swing body 120 faces. The position/azimuth direction-detecting device 125 includes two receivers that receive positioning signals from artificial satellites forming a global navigation satellite system (GNSS). The two receivers are installed at different positions on the swing body 120. The position/azimuth direction-detecting device 125 detects the position of a representative point of the swing body 120 in a site coordinate system based on the positioning signals received by the receivers. The representative point of the swing body 120 in the site coordinate system corresponds to, for example, the origin of an excavator coordinate system. The position/azimuth direction-detecting device 125 computes an azimuth direction which the swing body 120 faces using the respective positioning signals received by the two receivers, as a relationship between the installation position of one receiver and the installation position of the other receiver.

The inclination measuring instrument 126 measures the acceleration and the angular speed or swing speed of the swing body 120 and detects the posture of the swing body 120 based on the measurement results. The posture of the swing body 120 can be represented by, for example, a roll angle, a pitch angle, and a yaw angle. The inclination measuring instrument 126 is installed on, for example, a lower surface of the swing body 120. For example, an inertial measurement unit can be used as the inclination measuring instrument 126.

The hydraulic device 127 supplies hydraulic oil to the swing body 120, the carriage 110, the boom cylinder 134, the stick cylinder 135, and the bucket cylinder 136. The amount of hydraulic oil supplied from the hydraulic device 127 to the swing body 120, the carriage 110, the boom cylinder 134, the stick cylinder 135, and the bucket cylinder 136 is controlled by the controller 128.

The controller 128 receives an operation signal from the operation device 123. The controller 128 outputs the operation signal to the hydraulic device 127 to drive the work equipment 130, the swing body 120, or the carriage 110.

Configuration of Control System

FIG. 2 shows an example configuration of a control system 1 of the work machine 100 according to the embodiment of the present disclosure. As shown in FIG. 2, the work machine 100 includes a power source 301, a hydraulic pump 302, a control valve 300, and a swing motor 304 in addition to the above-mentioned components. The hydraulic pump 302, the control valve 300, and the swing motor 304 are included in the hydraulic device 127 shown in FIG. 1.

The power source 301 generates a driving force for operating the work machine 100. An internal combustion engine and an electric motor are exemplary examples of the power source.

The hydraulic pump 302 is driven by the power source 301 and discharges hydraulic oil. At least part of the hydraulic oil discharged from the hydraulic pump 302 is supplied to each of the boom cylinder 134, the stick cylinder 135, the bucket cylinder 136, the swing motor 304, and the carriage 110 via the control valve 300. The control valve 300 controls the flow rate and direction of the hydraulic oil that is supplied from the hydraulic pump 302 to each of the boom cylinder 134, the stick cylinder 135, the bucket cylinder 136, the swing motor 304, and the carriage 110. The work equipment 130 is operated by the hydraulic oil supplied from the hydraulic pump 302.

Configuration and Operation of Controller

Output signals of the operation device 123, the target object-detecting device 124, the position/azimuth direction-detecting device 125, the inclination measuring instrument 126, the boom angle sensor 137, the stick angle sensor 138, and the bucket angle sensor 139 are input to the controller 128. The controller 128 outputs an operation command to the control valve 300, and operates the work equipment 130, the swing body 120, or the carriage 110. The operation command includes a boom operation command that is an operation command of the boom cylinder 134, a stick operation command that is an operation command of the stick cylinder 135, and a bucket operation command that is an operation command of the bucket cylinder 136. The controller 128 is formed using, for example, a field programmable gate array (FPGA) or a microcomputer that includes a processor, a main storage device, an auxiliary storage device, an input/output device, and the like.

FIG. 3 is a configuration diagram showing the controller 128 of the work machine 100 according to the embodiment of the present disclosure. The controller 128 includes a work equipment control unit 400 as a functional component that is formed of hardware or a combination of hardware and software, such as a program. When the operator turns on the switch 123S of the operation device 123, the controller 128 starts the automatic loading control. A loading operation operated by the automatic loading control is a composite operation in which a plurality of actuators, which include the cylinders and the motor, for driving the work machine are operated simultaneously. In an example of the loading operation of the embodiment of the present disclosure, a composite operation of the lift of the boom by the boom cylinder and the swing by the swing motor is performed. The operation control of the work equipment 130 will be mainly described below. When the loading instruction signal is input to the controller 128, the controller 128 specifies the position of the work equipment 130 as a start position of the automatic loading control and specifies a loading position based on the position and shape of the loading target 200. The start position and the loading position may be specified using the position information of a transport vehicle that is obtained from the control of, for example, GNSS or an unmanned dump truck driving system. The controller 128 controls the work equipment 130 and the swing motor 304 such that, for example, the position of the bucket 133 reaches the loading position from the start position. The loading position is a target position in the automatic loading control, and will be referred to as a target position below. Further, at this time, the controller 128 controls the work equipment 130 such that the posture of the bucket 133 is held in a target posture so as not to change an angle of the bucket 133 to the ground or an angle of the bucket 133 to the swing body 120. In the present embodiment, the automatic loading control starts when, for example, the operator turns on the switch 123S of the operation device 123 and, for example, is a control to move the position of the bucket 133 to the target position from the start position of the automatic loading control while holding the posture of the bucket 133 in the target posture after the posture of the bucket 133 is changed to the target posture or maintaining the posture of the bucket 133 in the target posture when the posture of the bucket 133 is already the target posture. When the operator determines that, for example, a loading machine and a loading target, such as a transport vehicle or a hopper, are positioned such that loading processing can be performed, the operator turns on the switch 123S. Although FIG. 3 shows the controller 128 including only the work equipment control unit 400 as a functional component that controls the work equipment 130 in the automatic loading control, the controller 128 also includes functional components (not shown) that control the swing motor 304 and the carriage 110. The work equipment control unit 400 includes a first operation command-calculating unit 401, a target cylinder length-calculating unit 402, a cylinder length-calculating unit 403, a determination unit 404, an operation command-switching unit 405, and a second operation command-calculating unit 406.

In the present embodiment, in the automatic loading control, the work equipment control unit 400 performs the control of the work equipment 130 to hold the posture of the bucket 133 in the target posture and to move the position of the bucket 133 up to the target position. At that time, when the posture of the bucket 133 is out of a predetermined range from the target posture, the work equipment control unit 400 prioritizes the control of the posture of the bucket 133 over the control of the position of the bucket 133 until the posture of the bucket 133 falls within the predetermined range. In the present embodiment, the posture of the bucket 133 corresponds to an angle of a bucket plane 133S to be described later. Further, the position of the bucket 133 corresponds to, for example, the position of the bucket pin 133P. Furthermore, the target posture is, for example, a posture suitable for the bucket 133 to load the loading target object LO. Moreover, the target position corresponds to, for example, a position where the bucket 133 dumps the loading target object LO into the loading target 200. Further, the control of the work equipment 130 to hold the posture of the bucket 133 in the target posture and to move the position of the bucket 133 to the target position is started in response to, for example, a pressing operation on the switch 123S of the operation device 123 that is an example of an input device. This pressing operation is an example of a predetermined input operation of the present disclosure.

FIGS. 5 and 6 show examples of the control of the work equipment 130 in the automatic loading control that is performed by the work equipment control unit 400. FIG. 5 includes FIG. 5A that is a plan view schematically showing the work machine 100 and the loading target 200 and FIG. 5B that is a front view schematically showing the bucket 133 and the loading target 200. FIG. 6 shows an example of the control of the work equipment 130 in the automatic loading control that is performed by the work equipment control unit 400. In FIG. 6, examples of the bucket 133 in four states where postures or positions are different are shown as buckets 133-A1, 133-A2, 133-A3, and 133-A4. In FIG. 5, the loading target 200 is a dump truck.

As shown in FIG. 5B that is a front view, in the automatic loading control, the work equipment control unit 400 automatically controls the position of the bucket pin 133P until the position of the bucket pin 133P reaches a target position 133 PT from a start position 133PS. Here, the position of the bucket pin 133P includes a position in a vertical direction and a position in a front-rear direction. Hereinafter, a position in the vertical direction will be also referred to as a bucket height. In the present embodiment, the control of the position of the bucket pin 133P is referred to as "position control". Further, as shown in FIG. 6, the work equipment control unit 400 controls the position of the bucket 133 and also controls the posture of the bucket 133 such that an angle θb of the bucket plane 133S of the bucket 133 to the ground or an angle θb of the bucket plane 133S to the swing body 120 is held within a range of a target angle 133ST. Hereinafter, the angle θb will be also referred to as a bucket angle. In the present embodiment, the control of the angle θb of the bucket plane 133S will be referred to as "posture control". The bucket plane 133S is a plane that connects the bucket pin 133P and a distal end of the blade 133T. Here, the target angle 133ST is defined by a first angle θ1 and a second angle θ2 from a horizontal line HL, which passes through the bucket pin 133P and is based on the road surface RS or the swing body 120, as is exemplarily illustrated in the bucket 133-A2. The target angle 133ST includes a range of an angle between the first angle θ1 and the second angle θ2.

In FIG. 6, the bucket 133-A1 is in a state where a loading instruction signal is input, that is, in a state where the automatic loading control is started. The position of the bucket pin 133P of the bucket 133-A1 is the start position 133PS. Further, the angle θb of the bucket plane 133S of the bucket 133-A1 is outside a range of an allowable angle. Here, the allowable angle is an angle serving as a boundary of a range of an allowable angle in which the position control is allowed to be performed at the angle θb; the posture control is performed preferentially when the angle θb is out of the range of the allowable angle; and both or any one of the posture control and the position control is performed when the angle θb is in the range of the allowable angle. The allowable angle is defined by a third angle θ3 from the horizontal line HL, which passes through the bucket pin 133P and is based on the road surface RS or the swing body 120, as is exemplarily illustrated in the bucket 133-A2. The bucket 133-A2 is in a state where the angle θb between the horizontal line HL and the bucket plane 133S is equal to the third angle θ3 serving as the allowable angle. The bucket 133-A3 is in a state where the position of the bucket pin 133P is equal to a stick control start height threshold. Further, the bucket 133-A3 is in a state where the bucket plane 133S is within the target angle 133ST. Furthermore, the bucket 133-A4 is in a state where the position of the bucket pin 133P reaches the target position 133 PT.

In an example shown in FIG. 6, the distance between the boom pin 131P and the start position 133PS, which is a position of the bucket pin 133P of the bucket 133-A1 when the automatic loading control is started, is shorter than the distance between the boom pin 131P and the target position 133 PT, which is a position of the bucket pin 133P of the bucket 133-A4 when the position of the bucket pin 133P reaches the target position. Further, the start position 133PS is lower than the target position 133 PT. Accordingly, in this case, the bucket 133 is moved in an upward direction and is moved in a direction away from the boom pin 131P. In this case, when the bucket 133 is to be lifted in a state where the blade 133T faces downward as in the case of the bucket 133-A1, the bucket 133 receives a load of earth or the like on the bottom thereof. Accordingly, the bucket 133 receives a large load. For this reason, in the present embodiment, when the posture of the bucket 133 is out of a predetermined range from the target angle 133ST corresponding to the target posture, the posture control of the bucket 133 is prioritized over the position control of the bucket 133 until the posture of the bucket 133 falls within the predetermined range. A circle 133PC indicates a virtual trajectory of the bucket pin 133P of the bucket 133-A1 when only the boom 131 is virtually rotated by an angle of 360°.

In the example shown in FIG. 6, the control of the angle of the bucket plane 133S is prioritized until the state of the bucket 133-A2 from the state of the bucket 133-A1. The work equipment control unit 400 prioritizes the drive of the bucket cylinder 136 and stops or suppresses the drive of the boom cylinder 134 and the stick cylinder 135.

In the state of the bucket 133-A2 of which an angle between the horizontal line HL and the bucket plane 133S reaches the allowable angle, the work equipment control unit 400 releases the stop or suppression of the drive of the boom cylinder 134 and controls the posture and position of the bucket 133 via the drive of the bucket cylinder 136 and the boom cylinder 134. Here, the reason why the stop or suppression of the drive of the stick cylinder 135 is maintained is that, if both the stop or suppression of the drive of the boom cylinder 134 and the stop or suppression of the drive of the stick cylinder 135 are released, there is a possibility that an operation for pushing the bucket 133 into an excavation surface and an operation for lifting the bucket 133 occur simultaneously and a load applied to the work equipment 130 is excessive. In this state, the angle of the bucket plane 133S is outside the target angle 133ST; however, by starting the position control when the angle of the bucket plane 133S reaches the allowable angle at which an influence on an increase in load can be suppressed to a certain extent, a time required until the position of the bucket pin 133P reaches the target position 133 PT can be shortened while suppressing an influence on an increase in load to a certain extent.

Then, in the state of the bucket 133-A3 of which the position of the bucket pin 133P is higher than the stick control start height threshold, the work equipment control unit 400 releases the stop or suppression of the drive of the stick cylinder 135 and controls the posture and position of the bucket 133 via the drive of the bucket cylinder 136, the stick cylinder 135, and the boom cylinder 134. The work equipment control unit 400 controls the posture and position of the bucket 133 up to the target position, which is the position of the bucket 133-A4, via the drive of the bucket cylinder 136, the stick cylinder 135, and the boom cylinder 134. The stick control start height threshold may be a value corresponding to a height from the road surface RS, or may be, for example, a value based on the position of the boom pin 131P or the like. In this configuration, in the control of the position of the bucket 133, the work equipment control unit 400 limits the drive of the stick 135 when the position of the bucket pin 133P is lower than a predetermined threshold, which is the stick control start height threshold.

An angle of the bucket plane 133S of the bucket 133-A3 reaches the target angle 133ST in the example shown in FIG. 6. However, in the present embodiment, the work equipment control unit 400 releases the stop or suppression of the drive of the stick cylinder 135 when the position of the bucket pin 133P is higher than the stick control start height threshold even if the angle of the bucket plane 133S does not reach the target angle 133ST.

Further, as shown by a thick arrow in the plan view 5A, in the automatic loading control, the controller 128 performs a control of a swing direction that is a control of the position of the work equipment 130 in the horizontal direction. The control of the position of the work equipment 130 in the horizontal direction is not limited and can be performed by a method disclosed in, for example, Patent Document 2.

Returning to FIG. 3, in the work equipment control unit 400, the first operation command-calculating unit 401 calculates a boom operation command, a stick operation command, and a bucket operation command, which are given by manual operations, in response to operations input to the operation device 123 by the operator, and outputs the calculated boom operation command, the calculated stick operation command, and the calculated bucket operation command to the operation command-switching unit 405.

When the switch 123S of the operation device 123 is turned on, the target cylinder length-calculating unit 402 determines a target boom cylinder length and a target stick cylinder length, which allow the bucket pin 133P to reach the target position 133 PT, based on the respective output signals of the target object-detecting device 124, the position/azimuth direction-detecting device 125, the inclination measuring instrument 126, the boom angle sensor 137, the stick angle sensor 138, and the bucket angle sensor 139, outputs the determined target boom cylinder length and the determined target stick cylinder length, and also calculates a target bucket cylinder length based on an actual boom cylinder length and an actual stick cylinder length so that the bucket 133 has the target posture, and outputs the calculated target bucket cylinder length.

The cylinder length-calculating unit 403 calculates an actual boom cylinder length, an actual stick cylinder length, and an actual bucket cylinder length based on the respective output signals of the boom angle sensor 137, the stick angle sensor 138, and the bucket angle sensor 139, and outputs the calculated actual boom cylinder length, the calculated actual stick cylinder length, and the calculated actual bucket cylinder length. The cylinder length-calculating unit 403 may be included in the target cylinder length-calculating unit 402.

The determination unit 404 determines whether the angle of the bucket plane 133S is less than the allowable angle and determines whether the position of the bucket pin 133P is higher than the stick control start height threshold based on the respective output signals of the boom angle sensor 137, the stick angle sensor 138, and the bucket angle sensor 139, and outputs the determination results.

The target boom cylinder length, the target stick cylinder length, and the target bucket cylinder length output from the target cylinder length-calculating unit 402, the actual boom cylinder length, the actual stick cylinder length, and the actual bucket cylinder length output from the cylinder length-calculating unit 403, and the determination results output from the determination unit 404 are input to the second operation command-calculating unit 406; and the second operation command-calculating unit 406 calculates a boom operation command, a stick operation command, and a bucket operation command and outputs the calculated boom operation command, the calculated stick operation command, and the calculated bucket operation command to the operation command-switching unit 405.

An operation state of the operation device 123, the boom operation command, the stick operation command, and the bucket operation command output from the first operation command-calculating unit 401, the boom operation command, the stick operation command, and the bucket operation command output from the second operation command-calculating unit 406, the target boom cylinder length, the target stick cylinder length, and the target bucket cylinder length output from the target cylinder length-calculating unit 402, and the actual boom cylinder length, the actual stick cylinder length, and the actual bucket cylinder length output from the cylinder length-calculating unit 403 are input to the operation command-switching unit 405.

Based on those input signals, the operation command-switching unit 405 selects and outputs the boom operation command, the stick operation command, and the bucket operation command output from the second operation command-calculating unit 406 during an execution period of the automatic loading control which is a period from the start to the end of the automatic loading control, and selects and outputs the boom operation command, the stick operation command, and the bucket operation command output from the first operation command-calculating unit 401 when the automatic loading control is not performed. For example, the operation command-switching unit 405 starts the automatic loading control when the switch 123S is turned on and ends the automatic loading control when each actual cylinder length reaches each target cylinder length or when a predetermined stop operation is performed on the operation device 123.

Here, an example configuration of the second operation command-calculating unit 406 shown in FIG. 3 will be described with reference to FIG. 4. The second operation command-calculating unit 406 shown in FIG. 4 includes a table 501, a subtractor 502, an OR circuit 503, a delay circuit 504, a selector 505, a table 511, a subtractor 512, an OR circuit 513, a delay circuit 514, a selector 515, an AND circuit 516, a table 521, and a subtractor 522.

The subtractor 502 subtracts the actual boom cylinder length from the target boom cylinder length to calculate a boom cylinder length deviation and outputs the boom cylinder length deviation. The boom cylinder length deviation output from the subtractor 502 is input to the table 501, and the table 501 calculates a boom operation command corresponding to the deviation and outputs the boom operation command. A signal, which is "1" when the bucket angle is less than the allowable angle, and an output of the delay circuit 504 are input to the OR circuit 503, and the OR circuit 503 performs an OR operation and outputs the operation result. The output of the OR circuit 503 is input to the delay circuit 504, and the delay circuit 504 delays the output by one computational step and outputs the delayed output. The delay circuit 504 is reset when the automatic loading control is started or ended. The selector 505 selects and outputs the output of the table 501 when the output of the OR circuit 503 is "1" and selects and outputs an input of "0" when the output of the OR circuit 503 is "0". In the above-mentioned configuration, after the automatic loading control is started, "0" is output as the boom operation command while the bucket angle is not less than the allowable angle. On the other hand, when the bucket angle is less than the allowable angle even once, the output of the table 501 is continuously output as the boom operation command thereafter.

Further, the subtractor 512 subtracts the actual stick cylinder length from the target stick cylinder length to calculate a stick cylinder length deviation and outputs the stick cylinder length deviation. The stick cylinder length deviation output from the subtractor 512 is input to the table 511, and the table 511 calculates a stick operation command corresponding to the deviation and outputs the stick operation command. A signal, which is "1" when the bucket angle is less than the allowable angle, and a signal, which is "1" when an actual bucket pin height is higher than the stick control start height threshold, are input to the AND circuit 516, and the AND circuit 516 performs an AND operation and outputs the operation result. The output of the AND circuit 516 and an output of the delay circuit 514 are input to the OR circuit 513, and the OR circuit 513 performs an OR operation and outputs the operation result. The output of the OR circuit 513 is input to the delay circuit 514, and the delay circuit 514 delays the output by one computational step and outputs the delayed output. The delay circuit 514 is reset when the automatic loading control is started or ended. The selector 515 selects and outputs the output of the table 511 when the output of the OR circuit 513 is "1" and selects and outputs an input of "0" when the output of the OR circuit 513 is "0". In the above-mentioned configuration, after the automatic loading control is started, "0" is output as the stick operation command while the bucket angle is not less than the allowable angle or the actual bucket pin height is not higher than the stick control start height threshold. On the other hand, when the bucket angle is less than the allowable angle and the actual bucket pin height is higher than the stick control start height threshold even once, the output of the table 511 is continuously output as the stick operation command thereafter.

Furthermore, the subtractor 522 subtracts the actual bucket cylinder length from the target bucket cylinder length to calculate a bucket cylinder length deviation and outputs the bucket cylinder length deviation. The bucket cylinder length deviation output from the subtractor 522 is input to the table 521, and the table 521 calculates a bucket operation command corresponding to the deviation and outputs the bucket operation command.

When the bucket operation command, the stick operation command, and the boom operation command are "0", the lengths of the bucket cylinder 136, the stick cylinder 135, and the boom cylinder 134 are maintained at lengths before the bucket operation command, the stick operation command, and the boom operation command become "0". Further, since circuit each of which returns an output of an OR circuit to an input of the OR circuit via a delay circuit are provided, selection states are maintained when the output of the table 501 and the output of the table 511 are once selected, even though the selection conditions of the output of the table 501 and the output of the table 511 are not satisfied afterwards.

FIG. 7 shows an example of processing performed by the second operation command-calculating unit 406 shown in FIG. 4. A flow shown in FIG. 7 is repeatedly performed at a predetermined cycle. When the flow shown in FIG. 7 is started, the second operation command-calculating unit 406 calculates a deviation between the target cylinder length and the actual cylinder length for each of the boom cylinder 134, the stick cylinder 135, and the bucket cylinder 136 (Step S1). Next, the second operation command-calculating unit 406 calculates each operation command based on each deviation (Step S2). After that, the second operation command-calculating unit 406 determines whether the bucket angle is less than the allowable angle (Step S3). When the bucket angle is less than the allowable angle ("Yes" in Step S3), the second operation command-calculating unit 406 determines whether the bucket pin height is higher than the stick control start height threshold (Step S4). When the bucket pin height is higher than the stick control start height threshold ("Yes" in Step S4), the second operation command-calculating unit 406 outputs each of operation commands of the boom, the bucket, and the stick (Step S5). When the bucket pin height is not higher than the stick control start height threshold ("No" in Step S4), the second operation command-calculating unit 406 outputs each of the operation commands of the boom and the bucket (Step S6). Further, when the bucket angle is not less than the allowable angle (in the case of "No" in Step S3), the second operation command-calculating unit 406 outputs the bucket operation command (Step S7).

By the above-mentioned processing, when the control of the work equipment 130 to hold the posture of the bucket 133 in the target posture and to change the position of the bucket 133 up to the target position is performed and the posture of the bucket 133 is out of a predetermined range from the target posture, the second operation command-calculating unit 406 can prioritize the posture control of the bucket 133 over the position control of the bucket 133 until the posture of the bucket 133 falls within the predetermined range. In the present disclosure, the predetermined range from the target posture is a range of an angle that includes a range of an angle from the horizontal line HL to the target angle 133ST and a range of an angle from the horizontal line HL to the allowable angle in the example shown in FIG. 6. The example shown in FIG. 6 is an exemplary example. In another embodiment of the present disclosure, for example, both the range of an angle from the horizontal line HL to the target angle 133ST and the range of an angle from the horizontal line HL to the allowable angle may be above or below the horizontal line HL, or the range of an angle from the horizontal line HL to the target angle 133ST may be below the horizontal line HL and the range of an angle from the horizontal line HL to the allowable angle may be above the horizontal line HL. Further, the target posture is a posture suitable for the bucket 133 to load the loading target object LO, and the target position corresponds to a position where the bucket dumps the loading target object LO. The posture suitable for the bucket 133 to load the loading target object LO is, for example, a posture in which the loading target object is less spilled while the bucket is moved to the target position or a posture in which the bucket pin and a blade edge of the blade of the bucket are horizontal. Furthermore, the target position is the target position 133 PT in the example shown in FIG. 6.

Next, an example of the control of the work equipment 130 in the present embodiment will be described. FIG. 8 shows combinations of a case in which the bucket angle is in or out of the range of the allowable angle and a case where the bucket height is higher or lower than the stick control start height threshold when the automatic loading control is started, and how a control aspect in the automatic loading control performed by the controller 100 changes by the combinations is indicated by white arrows.

In FIG. 8, a control aspect (C1) is control in which only the bucket cylinder 136 is driven. A control aspect (C2) is control in which the bucket cylinder 136 and the boom cylinder 134 are driven. A control aspect (C3) is control in which the bucket cylinder 136, the stick cylinder 135, and the boom cylinder 134 are driven. A change in a control aspect in the automatic loading control will be described below with reference to FIGS. 9 to 12.

In an example shown in FIG. 9, the bucket angle of a bucket 133-B1 when the automatic loading control is started is out of the range of the allowable angle, and a bucket height is lower than the stick control start height threshold. Further, a bucket height H1 of a bucket 133-B2 when the bucket angle falls within the range of the allowable angle is lower than the stick control start height threshold. A bucket 133-B3 corresponds to a case where a bucket height is higher than the stick control start height threshold and the bucket 133 has the target posture. A bucket 133-B4 corresponds to a case where the bucket 133 is moved to the target position. In the example shown in FIG. 9, the work equipment 130 is controlled in the flow of the control aspect (C1) (the bucket 133-B1 to the bucket 133-B2)→the control aspect (C2) (the bucket 133-B2 to the bucket 133-B3)→the control aspect (C3) (the bucket 133-B3 to the bucket 133-B4).

Figure 10:
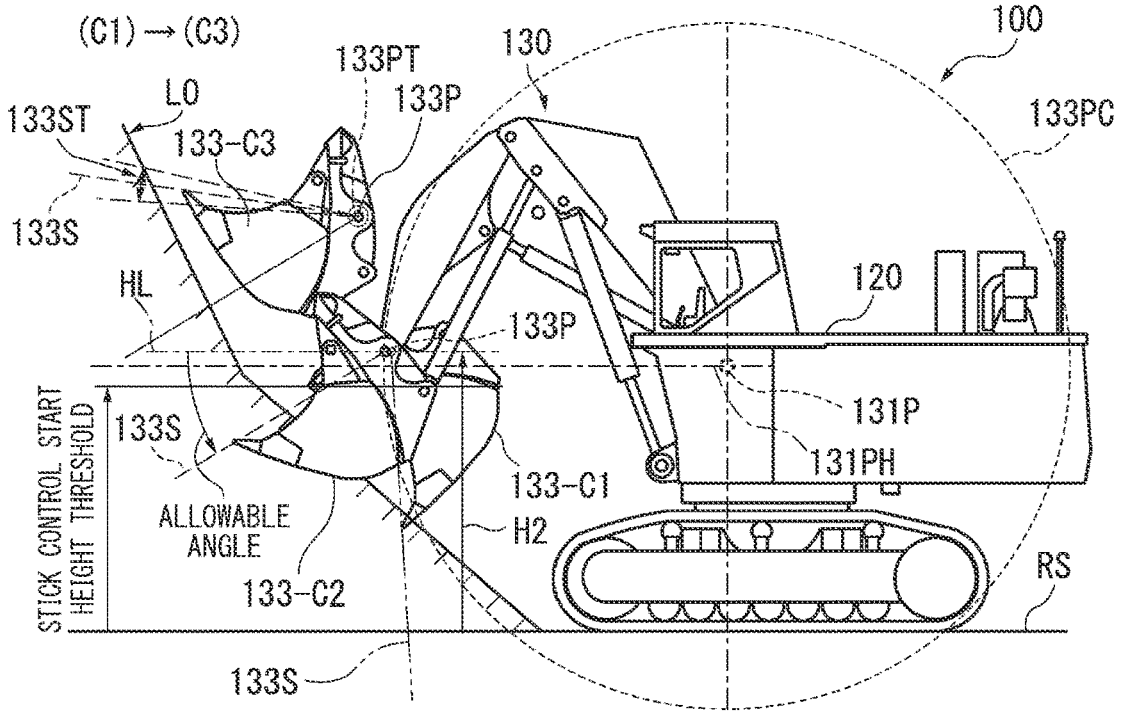
FIG. 10 is a side view showing an operation example of the work machine according to the embodiment of the present disclosure.

In an example shown in FIG. 10, the bucket angle of a bucket 133-C1 when the automatic loading control is started is out of the range of the allowable angle, and a bucket height H2 is higher than the stick control start height threshold. Further, a bucket height of a bucket 133-C2 when the bucket angle falls within the range of the allowable angle is also higher than the stick control start height threshold. A bucket 133-C3 corresponds to a case where the bucket 133 is moved to the target position in a state where the bucket 133 has the target posture. In the example shown in FIG. 10, the work equipment 130 is controlled in the flow of the control aspect (C1) (the bucket 133-C1 to the bucket 133-C2)→the control aspect (C3) (the bucket 133-C2 to the bucket 133-C3).

Figure 11:
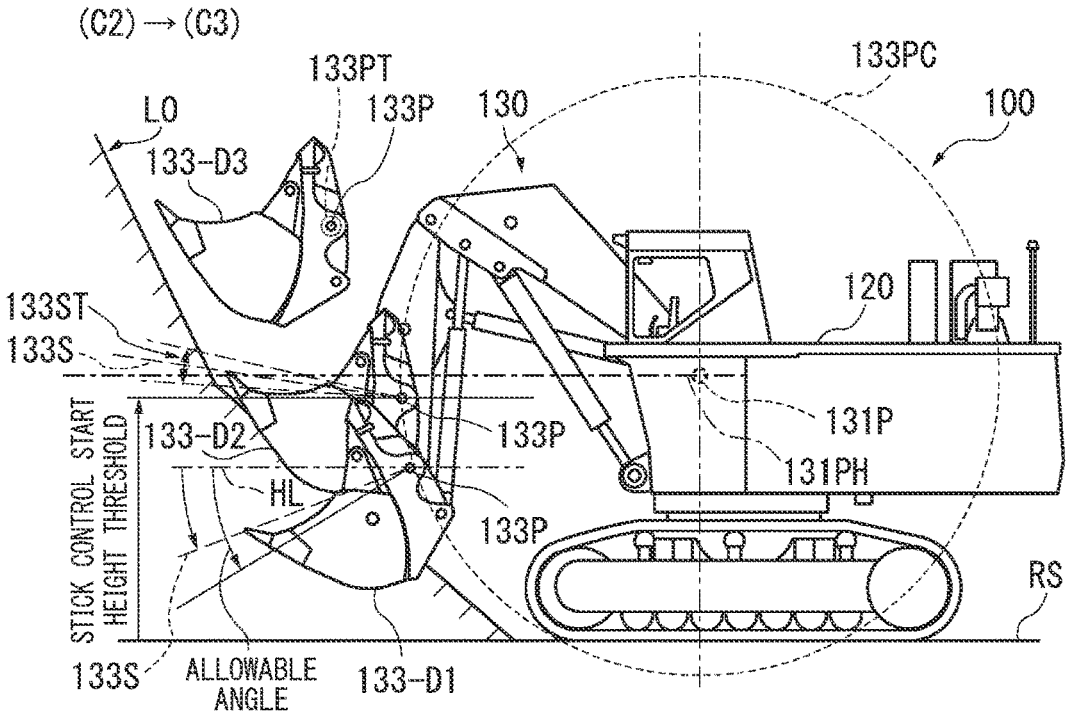
FIG. 11 is a side view showing an operation example of the work machine according to the embodiment of the present disclosure.

In an example shown in FIG. 11, the bucket angle of a bucket 133-D1 when the automatic loading control is started is in the range of the allowable angle, and a bucket height is higher than the stick control start height threshold. Further, a bucket 133-D2 when a bucket height is higher than the stick control start height threshold has the target posture. A bucket 133-D3 corresponds to a case where the bucket 133 is moved to the target position. In the example shown in FIG. 11, the work equipment 130 is controlled in the flow of the control aspect (C2) (the bucket 133-D1 to the bucket 133-D2)→the control aspect (C3) (the bucket 133-D2 to the bucket 133-D3).

Figure 12:
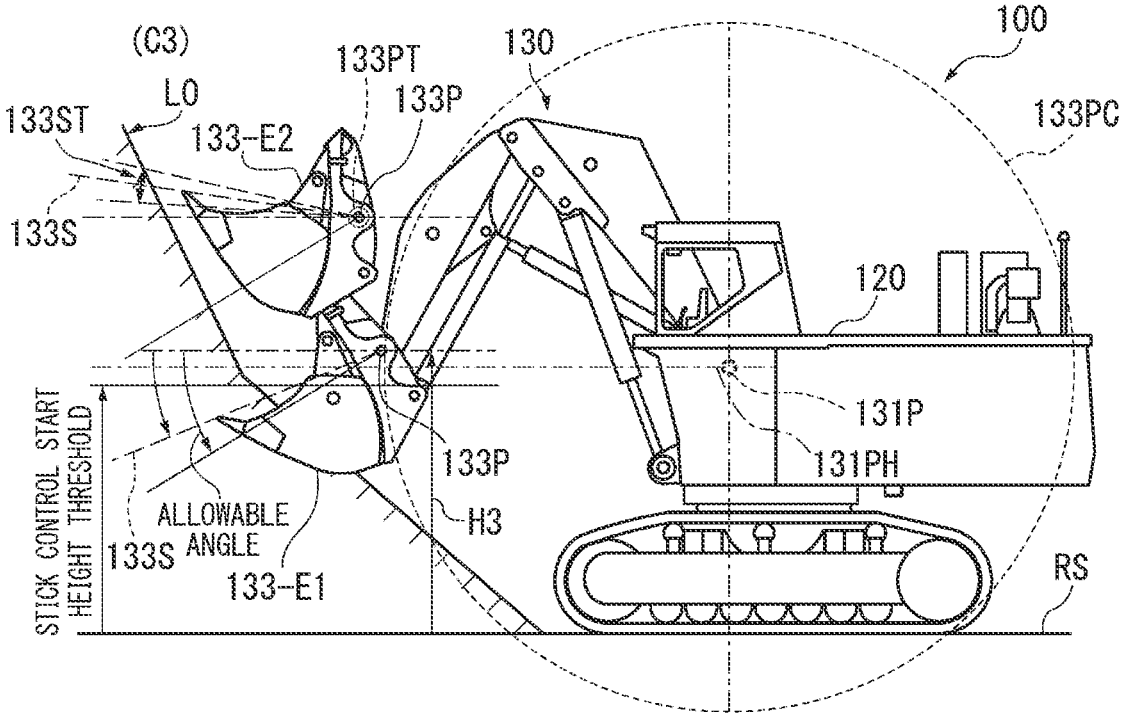
FIG. 12 is a side view showing an operation example of the work machine according to the embodiment of the present disclosure.

In an example shown in FIG. 12, the bucket angle of a bucket 133-E1 when the automatic loading control is started is in the range of the allowable angle, and a bucket height is higher than the stick control start height threshold. Further, a bucket 133-E2 corresponds to a case where the bucket 133 is moved to the target position. In the example shown in FIG. 12, the work equipment 130 is controlled in the state of the control aspect (C3) (the bucket 133-E1 to the bucket 133-E2).

Actions and Effects

As described above, in the present embodiment, the priority of the operations (operation commands) of the boom 131, the stick 132, and the bucket 133 is set depending on the position and posture of the bucket 133. In the present embodiment, when the blade 133T of the bucket 133 faces downward, the operation of the bucket 133 is prioritized to have a posture in which the blade 133T faces upward or is lifted. Further, when the bucket 133 is present at a low position, the operations of the boom 131 and the bucket 133 are prioritized to lift the bucket. After that, the stick 132 is extended. According to the present embodiment, since the operations of the boom 131 and the stick 132 are not controlled simultaneously, a load applied to the work equipment 130 can be appropriately controlled. At the time of loading a loading target object into the loading target 200, there may be a case where the bucket 133 does not reach the loading position when the stick 132 is not extended. In this case, the movement of the automatic loading control includes two operations, that is, an operation for extending the stick 132 to push the bucket 133 and an operation for driving the boom 131 or the stick 132 to lift the bucket 133. However, for example, when the stick 132 is already extended when the automatic loading control is started, an operation for driving the bucket 133 to lift the boom 131 is performed. According to the present embodiment, when the posture of the bucket 133 is out of the predetermined range from the target posture, the posture control of the bucket 133 is prioritized over the position control of the bucket 133 until the posture of the bucket 133 falls within the predetermined range. Accordingly, a load applied to the work equipment 130 can be appropriately controlled.

Hitherto, the embodiments of the present invention have been described with reference to the drawings; however, the specific configurations are not limited to the above-mentioned embodiments, and includes a design change and the like without departing from the scope of the present invention. In addition, programs executed by a computer in the above-mentioned embodiments can be partially or entirely distributed via a computer-readable recording medium or a communication line.

For example, the target position is automatically determined using the target object-detecting device 124 and the like in the above-mentioned embodiments, but the present disclosure is not limited thereto. For example, an operator may operate the work equipment 130 to manually set the target position and to perform teaching. Further, the position and posture of the work equipment 130 may be automatically controlled and the swing direction shown in FIG. 5 may be manually controlled. Furthermore, the automatic loading control may include control to cause the bucket 133 to perform a loading operation. For example, the loading operation can be performed by control to rotate the bucket 133 in a dump direction or control to open a clamshell when the bucket 133 is a clam bucket. Further, in the example shown in FIG. 4, whether to prioritize control is switched by switching whether to output an operation command. However, when control is not prioritized, instead of setting an operation command to zero, a value of the table may be suppressed at a constant ratio or may be fixed to a constant value. Furthermore, in another embodiment, instead of control based on the position of the bucket pin, control based on a predetermined position of the bucket other than the blade edge or the bucket pin, or control based on a preset position of the work equipment, such as the boom or the stick, may be performed in the same manner as control based on the position of the bucket pin.

INDUSTRIAL APPLICABILITY

According to each aspect of the present invention, it is possible to provide a control device, a work machine, a control method, and a control system that can appropriately control a load applied to work equipment.

The invention claimed is:

1. A control device of a work machine that includes (i) work equipment including a first member, a second member, and a work tool, and (ii) a swing body supporting the work equipment, the control device comprising:

a processor configured to perform an automatic loading control of holding a posture of the work tool in a target posture and moving a position of the work tool up to a target position, wherein the processor is configured to, based on the posture of the work tool being out of a predetermined range from the target posture in the automatic loading control, prioritize a control of the posture of the work tool over a control of the position of the work tool until the posture of the work tool falls within the predetermined range, and wherein the processor is configured to, based on a height of the work tool being lower than a predetermined threshold in the automatic loading control, stop driving of the second member while allowing driving of the first member.

2. The control device according to claim 1, wherein the target posture is a posture suitable for the work tool to load a loading target object, and wherein the target position corresponds to a position where the work tool dumps the loading target object.

3. The control device according to claim 1, wherein the automatic loading control is started in response to a predetermined input operation to a predetermined input device.

4. The control device according to claim 1, wherein the processor is configured to perform the automatic loading control to load a loading target object from the work tool to a transport vehicle.

5. The control device according to claim 1, wherein the first member of the work equipment comprises a boom configured to be driven by a boom cylinder, wherein the second member of the work equipment comprises a stick configured to be driven by a stick cylinder, wherein the work tool of the work equipment comprises a bucket configured to be driven by a bucket cylinder, and wherein the processor is configured to restrict operation of the stick cylinder while allowing operation of the bucket cylinder.

6. A work machine comprising:

work equipment including a first member, a second member, and a work tool;

a swing body supporting the work equipment; and a control device comprising a processor configured to perform an automatic loading control of holding a posture of the work tool in a target posture and moving a position of the work tool up to a target position, wherein the processor is configured to, based on the posture of the work tool being out of a predetermined range from the target posture in the automatic loading control, prioritize a control of the posture of the work tool over a control of the position of the work tool until the posture of the work tool falls within the predetermined range, and wherein the processor is configured to, based on a height of the work tool being lower than a predetermined threshold in the automatic loading control, stop driving of the second member while allowing driving of the first member.

7. A control method for a work machine that includes (i) work equipment including a first member, a second member, and a work tool, and (ii) a swing body supporting the work equipment, the control method comprising:

in an automatic loading control of holding a posture of the work tool in a target posture and moving a position of the work tool up to a target position, based on the posture of the work tool being out of a predetermined range from the target posture, controlling the work tool to prioritize a control of the posture of the work tool over a control of the position of the work tool until the posture of the work tool falls within the predetermined range; and based on a height of the work tool being lower than a predetermined threshold in the automatic loading control, stopping driving of the second member while allowing driving of the first member.

8. A control system of a work machine that includes (i) work equipment including a first member, a second member, and a work tool, and (ii) a swing body supporting the work equipment, the control system comprising:

a processor configured to perform an automatic loading control of holding a posture of the work tool in a target posture and moving a position of the work tool up to a target position, wherein the processor is configured to, based on the posture of the work tool being out of a predetermined range from the target posture, prioritize a control of the posture of the work tool over a control of the position of the work tool until the posture of the work tool falls within the predetermined range, and wherein the processor is configured to, based on a height of the work tool being lower than a predetermined threshold in the automatic loading control, stop driving of the second member while allowing driving of the first member.

* * * * *